United States Patent [19]

Gaitten

[11] 3,955,765

[45] May 11, 1976

[54] WHOLE TREE CHIPPER

[75] Inventor: Walden M. Gaitten, Sylacauga, Ala.

[73] Assignee: Kockum Industries, Inc., Talladega, Ala.

[22] Filed: June 27, 1974

[21] Appl. No.: 483,824

[52] U.S. Cl. ..... 241/28; 241/101.7; 241/152 A

[51] Int. Cl.[2] ..... B02C 18/06; B02C 21/02

[58] Field of Search..... 241/101.7, 32, 34, 152 R, 241/152 A, 186.4, 28

[56] References Cited

UNITED STATES PATENTS

| | | | |
|---|---|---|---|
| 3,545,692 | 12/1970 | Burkett | 241/101.7 X |
| 3,601,324 | 3/1970 | Brown | 241/101.7 X |
| 3,752,409 | 8/1973 | Lewis | 241/101.7 X |

*Primary Examiner*—Roy Lake
*Assistant Examiner*—E. F. Desmond
*Attorney, Agent, or Firm*—Cushman, Darby & Cushman

[57] ABSTRACT

A method of whole tree chipping and whole tree chipper with a funnel-shaped receiving structure for receiving the butt end of a tree while the top of the tree is supported by the ground, and for bending limbs thereof, and a pair of free-floating feed rollers for engaging the periphery of the tree and feeding the tree to a chipper. The funnel may have teeth disposed along the interior surface thereof and be rotatable automatically in response to hang-ups within the funnel to eliminate the hang-ups by twisting and cutting of the tree limbs. Hydraulic rams preferably bias the feed rollers toward each other, and bias them to a particular orientation with respect to the opening in the funnel. The centerline of the entrance to the chipper is located in line with or slightly above the centerline of the opening in the funnel, and preferably the funnel opening is slightly smaller than the chipper entrance.

35 Claims, 10 Drawing Figures

Fig. 3a
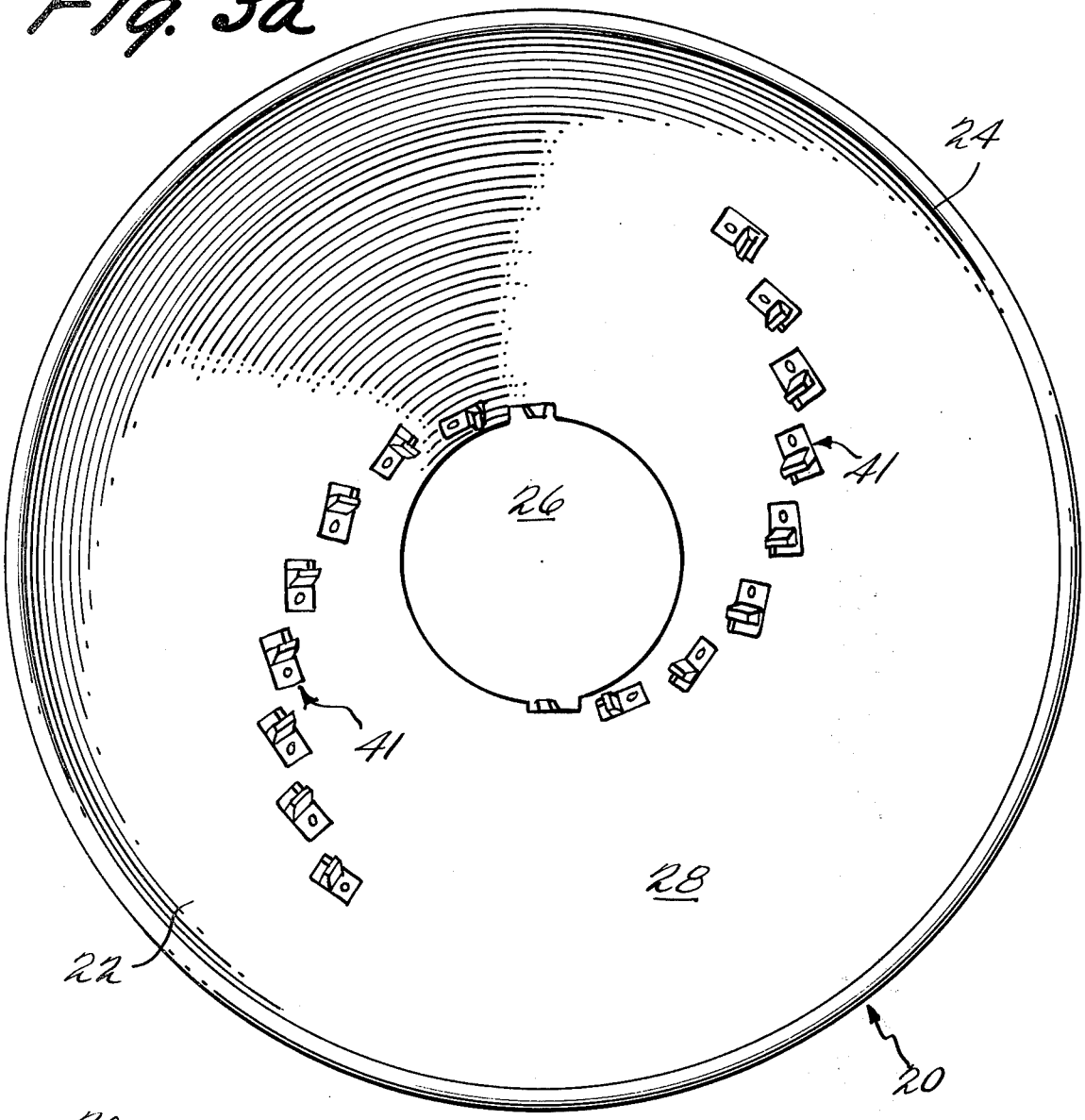
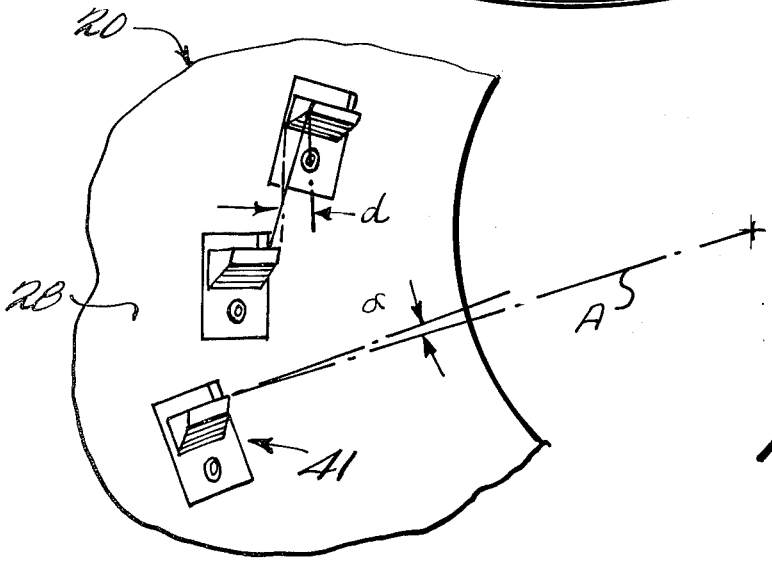
Fig. 3b

Fig. 7a
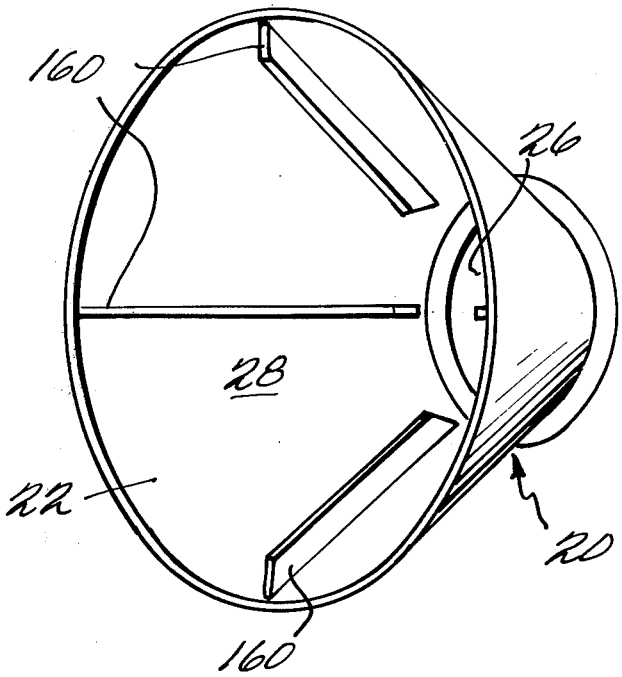
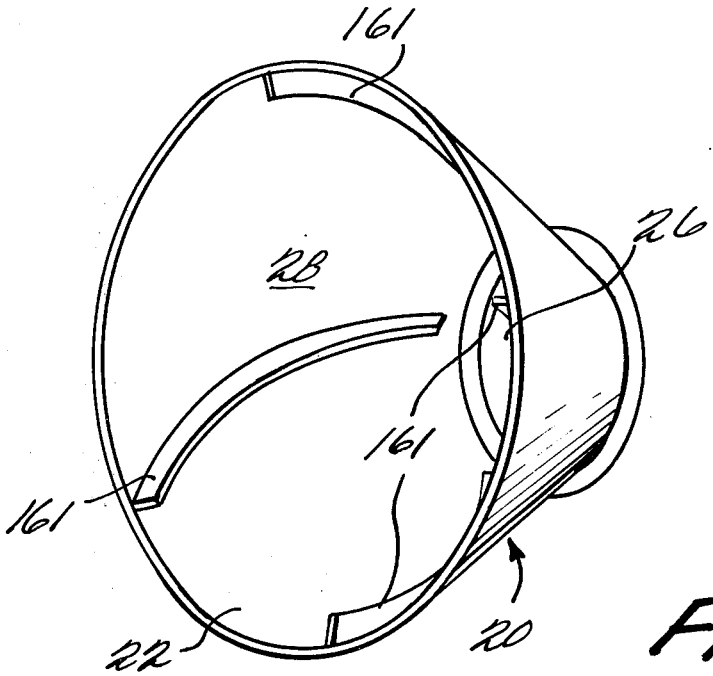
Fig. 7b

WHOLE TREE CHIPPER

BACKGROUND AND SUMMARY OF THE INVENTION

In the production of pulp for the making of paper and the like, and in the production of other articles from wood chips, it has been found to be economically feasible to take whole trees and turn them into chips in the field. Several problems that have been associated with commercial prior art devices, of which the device disclosed in U.S. Pat. No. 3,661,333 is an example, for turning whole trees into chips in the field have been the large size of the apparatus used and the vehicles associated therewith, and the large amount of down-time required due primarily to jamming of the feed mechanisms therefor. According to the teachings of the prior art, a whole tree is lifted or heeled onto a conveyor chain by a knuckle boom with a heel plate, which conveyor feeds the tree to various feed rolls, and then on into a chipper. In operation, large tree limbs often result in jamming of the feed mechanism, and jamming also results from debris being caught in the conveyor mechanism. Jamming of the feed mechanism usually requires the operator to hand-cut the jamming material from the feed mechanism, resulting in a great waste of time, and consequent reduction in any economic advantages of whole tree chipping in the field.

According to the teachings of the present invention, a feed mechanism is employed that substantially reduces the down-time of a whole tree chipper, and in addition provides for a whole assembly that is lighter in weight and smaller in size, and that does not require nearly as large a boom mechanism for bringing cut trees into operative engagement with the assembly, or if the same size boom is employed no heel plate is needed and tree manipulative ability is increased. According to the present invention, the conveyor chain is eliminated and a particular funnel is used to reduce hang-ups. The funnel provides for deflecting of the tree limbs so that they may be engaged by feed rolls and fed to the chipper. Preferably, the funnel is rotatable and has particularly disposed teeth along the interior surface thereof so that should a large limb or the like jam the feed orifice, rotation of the funnel will automatically be initiated, and the obstruction will be cut off and/or twisted so that feed to the feed rolls will not be prevented.

The feed rolls according to the present invention are movable toward and away from each other and biased toward each other by a gripper ram, and the rolls assembly itself is movable with respect to the funnnel orifice by a floating ram, which also provides a particular bias. Thus, the feed rolls are free-floating, and will assume any required orientation in their plane of movement with respect to the funnel orifice to accommodate variously sized and positioned trees.

Since there is no conveyor for bringing cut trees to the chipper according to the teachings of the present invention, there is no need to provide a large knuckle boom to lift the trees — instead, a smaller boom-mounted grapple or the like may be provided to merely drag a cut tree to the apparatus of the present invention, and lift only the trunk portion thereof off the ground into the funnel orifice, while the rest of the tree rests on the ground. Also, it is preferable to further ensure that no hang-ups will occur at the chipper itself by making the funnel orifice slightly smaller than the chipper orifice.

Since there is no cumbersome conveyor mechanism, and since the boom may be much reduced in size, all the advantages attending a smaller mechanism ensue, such as more maneuverability to position the apparatus in the most advantageous position, no special road permit being required to move the apparatus on the road, reduced construction costs, reduced fuel consumption for running and moving the apparatus, and fewer parts used in the construction and thus less required maintenance.

The principal object of the present invention is to provide an improved method and apparatus for total tree chipping. This and other objects of the invention will become clear from an inspection of the detailed description of the invention and from the appended claims.

BRIEF DESCRIPTION OF THE DRAWINGS

FIG. 2*b* is a top plan view of the feed mechanism shown in FIG. 2*a;*

FIG. 3*a* is a frontal view of a funnel receiving means according to the teachings of the present invention;

FIG. 3*b* is a fragmentary detail view of several teeth of the funnel of FIG. 3*a* showing their relative orientations;

FIGS. 7*a* and 7*b* are modified forms of the funnel of the present invention.

DETAILED DESCRIPTION OF THE INVENTION

Figure 1:
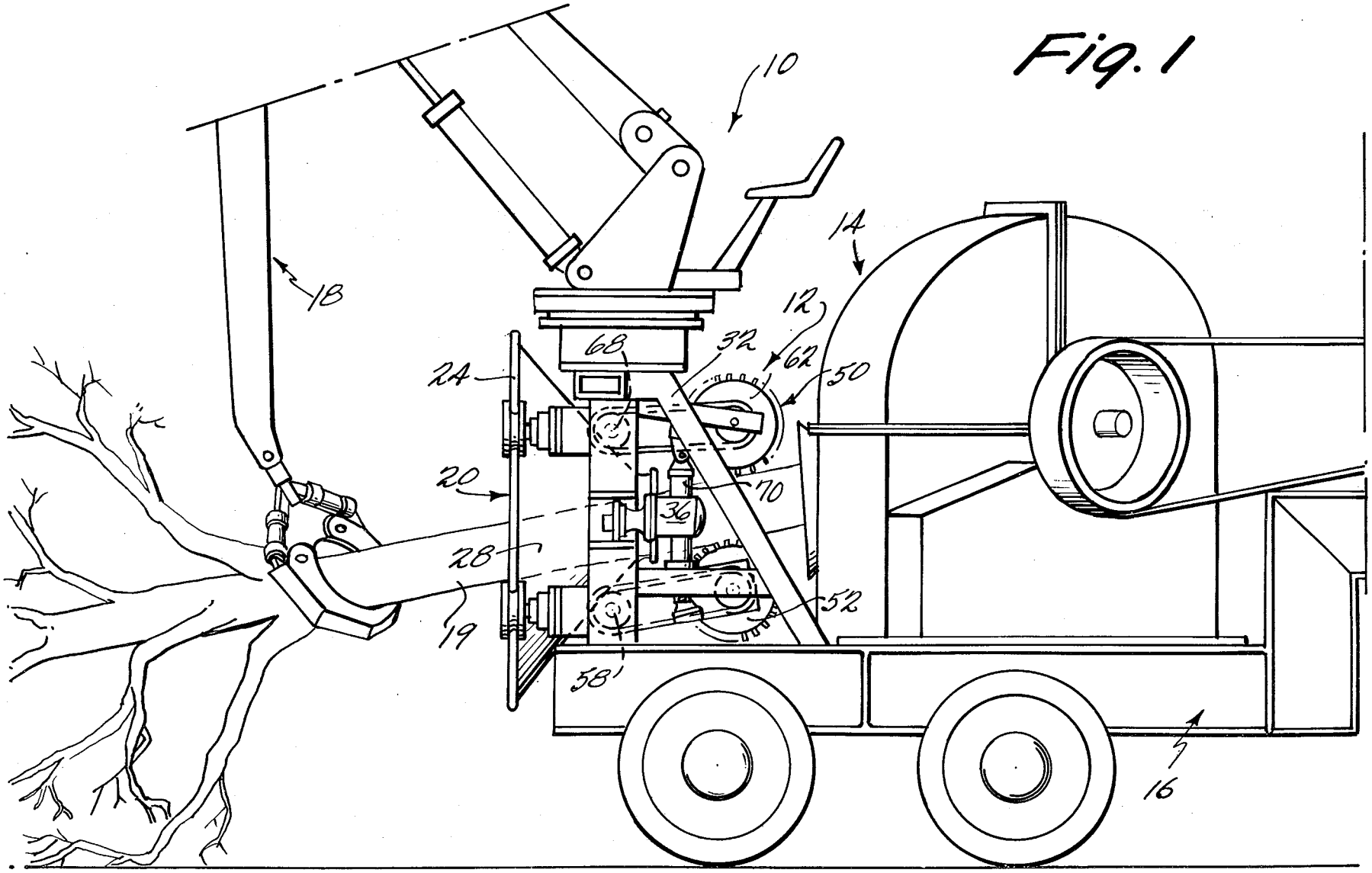
FIG. 1 is a side view of a total tree chipper, according to the teachings of the present invention, in operation.

Apparatus for reducing a whole tree into chips according to the teachings of the present invention is shown generally at 10 in FIG. 1. The apparatus comprises several main components: a feed mechanism, shown generally at 12, a chipper and distributing means therefor, shown generally at 14, and a crane or boom-mounted grapple, shown generally at 18, for moving the butt end of a tree 19 into operative relationship with the feed mechanism 12. As shown, the apparatus including boom-mounted grapple 18 — is mounted on a vehicle 16 which is pulled by a truck or tractor. It is to be understood, however, that the crane 18 could be mounted on the truck or tractor pulling the vehicle 16, or could be mounted on an entirely separate vehicle. The crane 18 is of relatively light construction since, as shown in FIG. 1, it will not be required to lift the whole tree off the ground, but rather it need only lift the butt end off the ground and move it into operative relationship with the feed mechanism 12, while the top end of the tree 19 will remain on the ground.

The feed mechanism 12 according to the teachings of the present invention is comprised of two main components: a funnel-shaped receiving structure, shown generally at 20, and a feed roller assembly, shown generally at 50. The funnel-shaped receiving structure 20 comprises a large opening 22 defined by a mounting rim portion 24, a small opening 26 spaced interiorly of the opening 22, and a converging interior surface 28 leading from the large opening 22 to the small opening 26. The small opening 26 is dimensioned so that the butt end of any tree that will be handled by the apparatus may pass therethrough. As will be readily apparent, as a tree is moved into the opening 22 of the receiving structure 20, its limbs will be gradually bent by the converging interior surface 28 so that as the tree is pulled through the opening 26 by the feed roller assembly 50 (as will be further explained below), all the limbs can be pulled therewith, and will not have a tendency to "hang-up" in the receiving structure 20.

Despite the fact that the receiving structure 20 will result in a reduced frequency of limbs hanging up therein than the conveyors of the prior art, there still always will be trees having limbs that will "hang-up" therein. To further prevent such hang-ups, means for rotating the whole receiving funnel 20 and teeth 41 (see FIGS. 3*a*, 3*b* and 4) associated therewith are provided. The funnel 20 is mounted for rotation about an axis through the centerline 27 of the openings therein by a plurality of rollers 30 mounted on a frame 32 secured to the vehicle 16. Each roller 30 has the periphery 34 thereof shaped so that it receives the mounting rim portion 24 of the funnel 20. The power for rotating the funnel 20 is supplied by a hydraulic motor 36 which drives a sprocket 37 which in turn drives the sprocket 39 rigidly attached to the funnel 20 around the opening 26 thereof, via a chain (not shown). The hydraulic motor 36 is automatically actuated in response to a "hang-up" within the funnel 20, as will be described more fully below.

Figure 4:
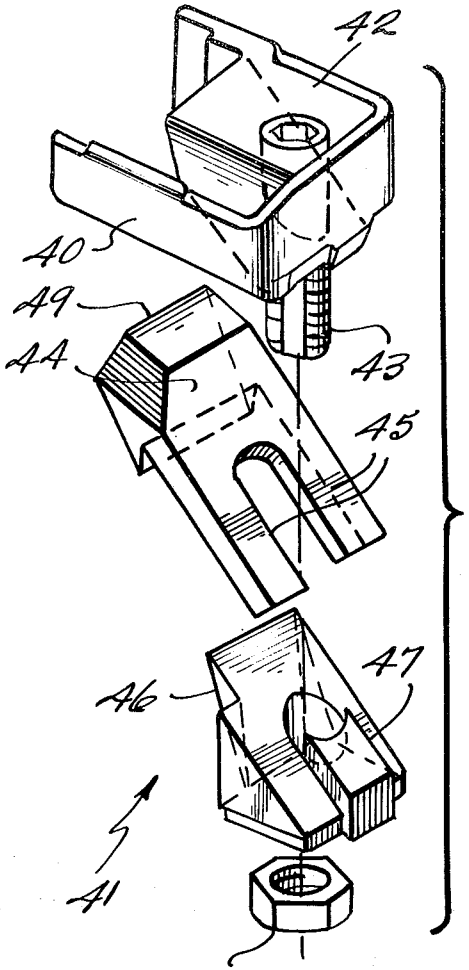
FIG. 4 is an exploded detail view of a cutting tooth on the interior funnel as shown in FIGS. 3*a* and 3*b;*

As shown most clearly in FIGS. 3*a*, 3*b* and 4, a plurality of teeth, shown generally at 41, are disposed along spiral paths along the interior surface 28 of the funnel 20. Each tooth 41 comprises a mounting portion 42 having side portions 40 and having a screw-threaded post 43 depending from the bottom thereof, a blade 44 having guide surfaces 45 thereof, a guide 46 having guide surfaces 47 thereof, and a nut 48. The mounting portion 42 is inserted into an aperture in the wall 28 of the funnel 20, and the mounting portion 42 is then rigidly affixed to the wall, as by welding the side portions 40 thereof to the wall 28. Then the blade 44 and the guide 46 are passed over the post 43 of the mounting portion 42, and the extent that the blade 44 extends into the interior of the funnel 20 is determined by adjusting the relative position between the blade 44 and the guide 46 as their respective guide surfaces 45,47 engage. The blade is then maintained in this position by tightening of the nut 48 on the post 43. Naturally, the extent that the blade 44 protrudes can thereafter be easily adjusted by simply untightening the nut 48 and sliding the blade 44 to its desired position with respect to the guide 46.

As seen in FIG. 3*a* the teeth 41 are arranged along the interior surface 28 of the funnel 20 along two spiral paths. In order to get maximum cutting efficiency with noncoring and self-feeding action when the funnel 20 is rotated, as shown most clearly in FIG. 3*b*, each blade 44 of each tooth 41 overlaps the previously disposed blade 44 by a distance "*d*", approximately ⅛ inch, and the plane of edge 49 of each blade 44 is arranged so that it is tilted outwardly an angle "$\alpha$", approximately 3°, from a radial line "A" of the funnel 20. As is readily apparent, when a hang-up occurs within the funnel 20, the motor 36 is activated and rotates the whole funnel, rotation of the funnel 20 resulting in twisting of the tree limbs hung-up within the funnel (especially smaller limbs), and resulting in cutting of those limbs engaged by the teeth 41 (especially larger limbs). Rotation of the funnel 20 will continue until the hang-up is removed, whereupon the motor 36 will automatically be deactivated. Any debris cut from the tree that does not pass through the opening 26 will merely fall to the ground in front of opening 22, and will not interfere with further operations of the assembly.

Modified forms of cutting means associated with the funnel 20 are illustrated in FIGS. 7*a* and 7*b*. In FIG. 7*a* sharpened steel plates 160 are disposed in the interior of the funnel 20. The plates 160 are preferably about 2 inches in height, are welded to the interior surface 28 of the funnel 20, and are arranged radially. In FIG. 7*b* sharpened plates 161 are disposed on the interior surface 28 of the funnel 20, but instead of being arranged radially, these plates are disposed along a generally spiral path, the spirals curving in the direction opposite to the direction of rotation of the funnel 20. Obviously, the plates 161 could be sectioned and each section thereof disposed along a spiral path. Since the plates 160,161 are welded to the funnel, there are no apertures leading from the exterior of the funnel to the interior thereof.

Figure 5:
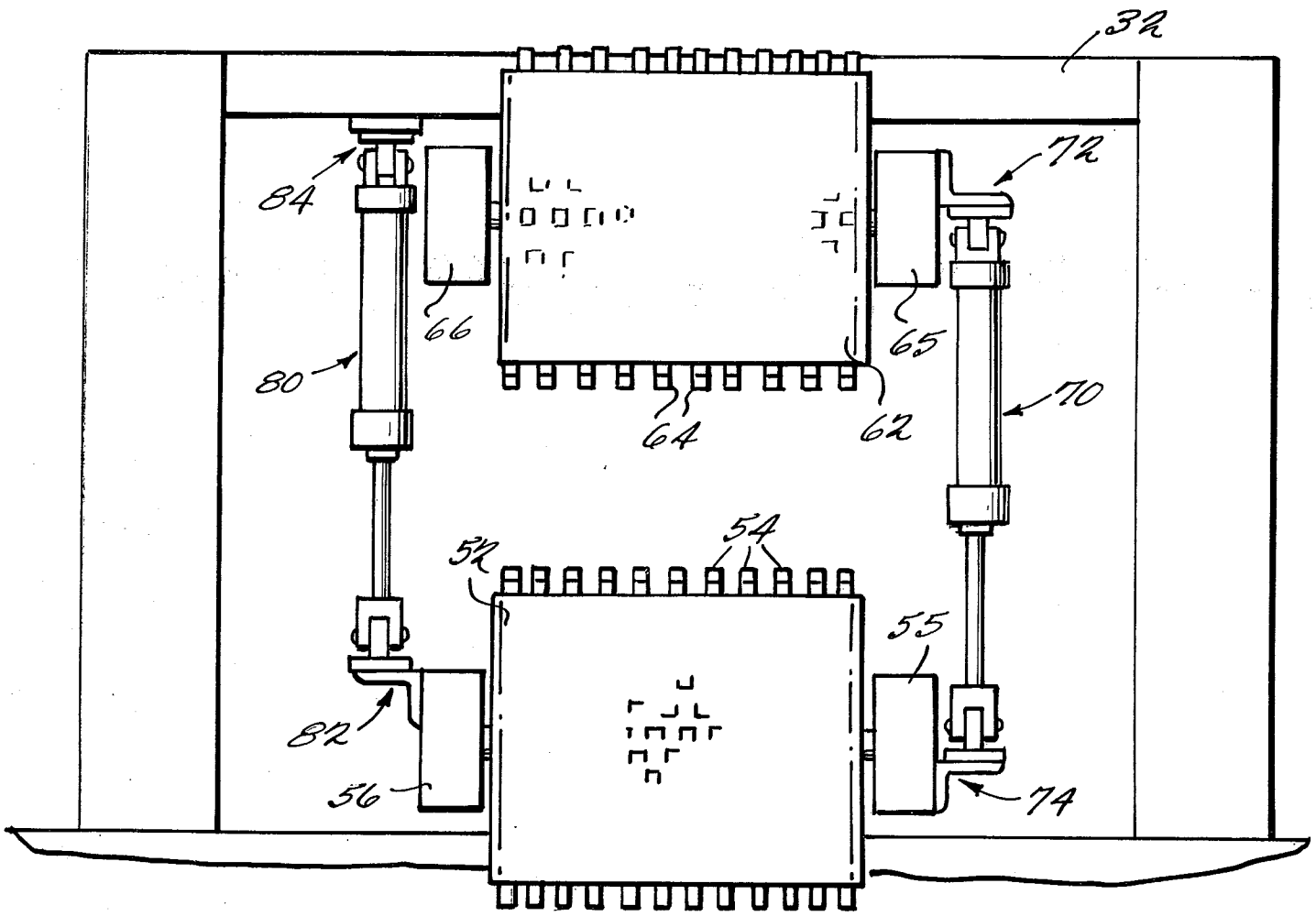
FIG. 5 is a detail rear end view of feed rolls and operating rams therefor taken along lines 5—5 of FIG. 2*a;*

Located interiorly of the funnel 20 along the direction of feed is the feed roller assembly 50. As shown most clearly in FIGS. 1 and 5, the feed roller assembly comprises a bottom roller 52 having transversely elongated ribs or projections 54 thereon and mounted by a pair of arms 55,56 pivoted about a shaft 58 connected to frame 32, a top roller 62 having transversely elongated ribs or projections 64 thereon and mounted by a pair of arms 65,66 pivoted about a shaft 68 connected to frame 32, a pinch ram 70, and a floating ram 80. Although the rollers have been illustrated as being disposed horizontally and rotatable about a horizontal axis, it is to be understood that they could be disposed vertically. Additionally, another set of rollers could be provided, although one set is sufficient.

Figure 2A:
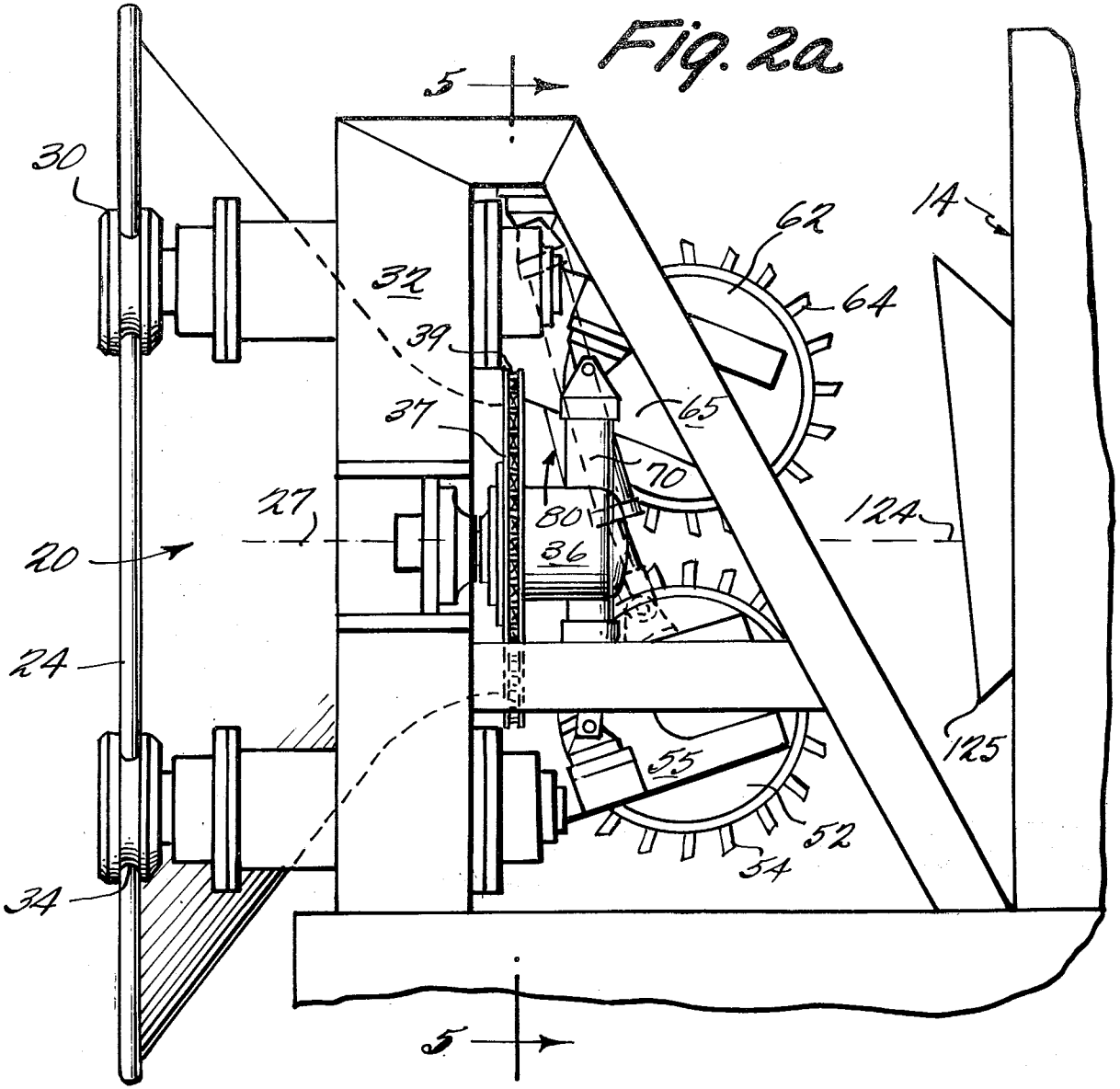
FIG. 2*a* is a side detail view of a feed mechanism, according to the teachings of the present invention in its normal position.
Figure 23:
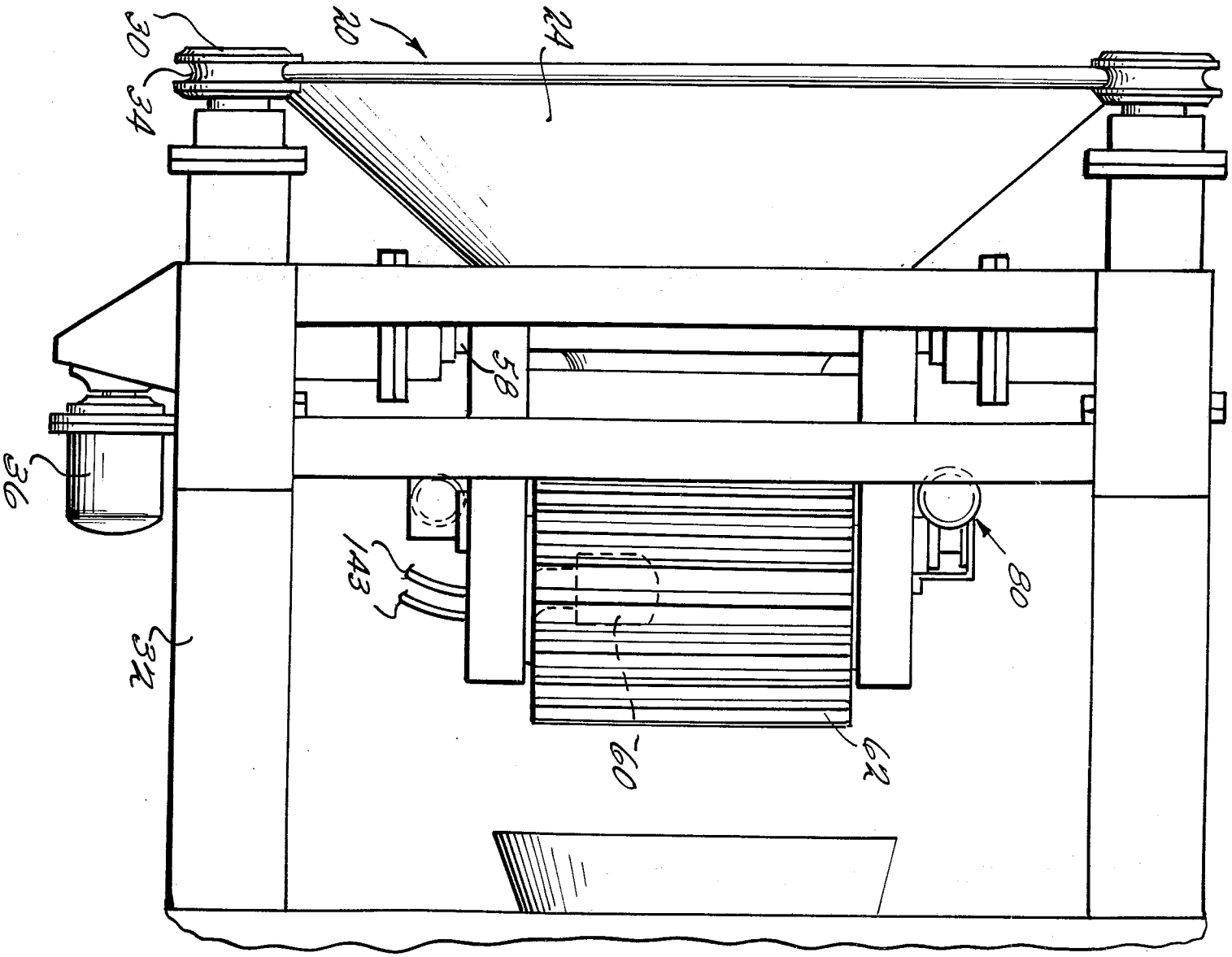
Figure 6:
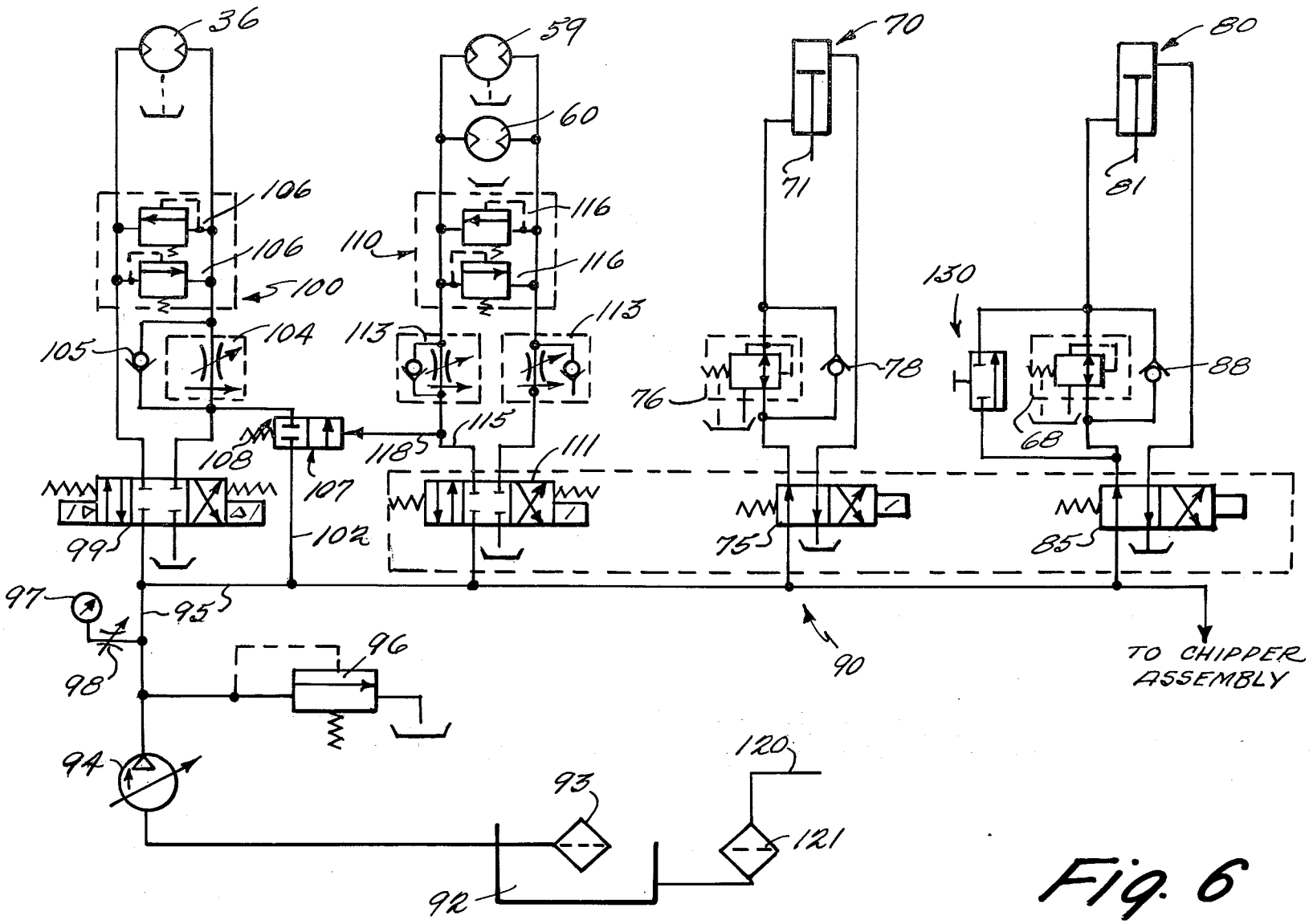
FIG. 6 is a schematic diagram of a hydraulic control circuit for controlling the apparatus shown in FIGS. 1–5.

Each roller 52,62 is rotated about its horizontal axis by its respective hydraulic motor 59, or 60 respectively (see FIG. 6). The motor 59 is mounted to one of the arms 55,56 and the motor 60 is mounted to one of the arms 65,66 so that the motors are movable vertically with the rollers 52,62. During normal operation the roller 52 is driven clockwise and the roller 62 is driven counterclockwise by the hydraulic motors. The motor 60 for roller 62 with hydraulic lines 143 attached thereto is shown in dotted line in FIG. 2b.

It is an essential feature of the present invention that the feed rollers 52,62 be able to adjust their orientation with respect to the opening 26 in funnel 20 in order to accommodate variously sized trees disposed at different angles with respect to the centerline 27 through opening 26 and so that the tree may assume the position within the chipper which the chipper directs it to assume. At the same time the rollers must exert enough engaging force on a tree being acted thereon so that the tree will be fed to the chipper assembly 14 and so that the angle of tilt will not be restricted. The rollers 52,62 must thus be "free-floating". "Free-floating" of the rollers is accomplished by the ram 80. The pinch ram 70 has one end thereof rigidly connected at 72 to arm 65 of roller 62, and the other end thereof rigidly connected at 74 to arm 55 of roller 52. Once the device is started up, hydraulic fluid will pass through operator controlled valve 75 (FIG. 6) through pressure reducing valve 76 on to ram 70. Preferably, the pressure reducing valve 76 has a built-in relieving feature and is adjustable; it may be of the type sold under the brand name *Fluid-Controls, Model No.* 1PAA21-R4-30S. An adjustable amount of pressure is thus always supplied to ram 70 tending to withdraw the piston rod 71 thereof and thus bring the rollers 52,62 closer together, however, the amount of pressure is small enough that it may be overcome by a tree passing through the rollers 52,62 and thus the rollers 52,62 will have the tendency to always tightly engage a tree being fed thereby, while not engaging it so tightly that the rollers will bind. To initially position the rollers to have the correct spacing to engage the butt end of a tree, the operator controllable valve 75 will be used. Note that the rollers may never move so close together that they will touch — preferably there will always be a spacing of approximately one inch between the respective projections 54,64 thereof when they are in their position closest together, to which position they are biased by the ram 70 (see FIG. 2*a*).

The floating ram 80 has one end thereof rigidly connected at 82 to arm 56 of roller 52, and the other end thereof rigidly connected at 84 to frame 32. By biasing the roller 52, the ram 80 obviously biases both rollers since they are operatively connected by ram 70. The fluid circuitry for ram 80 is the same as that for ram 70 (see FIG. 6), the piston rod 81 of the ram 80 is normally half-way between the ends of the cylinder and biases the rollers to the position shown in FIG. 2a by fluid flowing through operator controllable solenoid operated valve 85 and through pressure reducing valve 86 on to ram 80. Again, a check valve 88 is provided to allow backflow of the fluid through the line if the force exerted by the tree tending to raise the rollers is large enough. Again too, the operator can initially position the valve 85 to adjust the position of the ram 80 initially to accommodate the particular angle at which the butt end of a tree is extending through opening 26 in funnel 20.

As shown in FIG. 6, the whole feed mechanism 12 (and the hydraulic mechanisms associated with the conventional chipper assembly 14) is operated by hydraulic operated devices supplied by hydraulic circuitry, shown generally at 90. In operation of the device hydraulic fluid in main reservoir 92 is normally passed through magnetic suction strainer 93 to pressure compensated pump 94 through line 95 on to the various control systems. The pressure compensated pump 94 is run by a diesel engine, which may be separate from or the same as the diesel engine that runs the chipper assembly 14. Preferably, a relief valve 96 and a pressure gauge 97 with shut-off valve 98 therefor are provided to monitor the pressure in the line 95. Fluid does not normally flow through 3-position valve 99 to control system 100 for the funnel drive motor 36; however, the valve 99 may be actuated by the operator to cause the hydraulic motor 36 to drive the funnel 20 in either direction. The control system 100 includes an adjustable pressure compensated flow control 104, a check valve 105, dual adjustable relief valves 106, and a pressure responsive valve 107, as will be more fully described subsequently.

Fluid flowing through line 95 is normally allowed to flow through valve 111 of feed-rollers control system 110 by the operator positioning the valve 111 so that the hydraulic motor 59 will drive the roller 52 clockwise, and the hydraulic motor 60 will drive the roller 62 counterclockwise. Obviously, the motors 59,60 can be reversed to drive the rollers in the opposite directions by controlling valve 111. Pressure compensated flow control units 113 and dual adjustable relief valves 116 are provided in control system 110 to regulate and stabilize the flow therethrough. Should the pressure become too great in line 115 (which is the input line when the motors 59 and 60 are driving the rollers for feeding) — as would result when a hang-up occurred in the funnel 20 resulting in a back-up pressure in line 115 since the motors 59 and 60 would not be able to rotate the feed rolls — fluid will flow through line 118 to operate the fluid responsive valve 107 against the bias of spring 108 to allow fluid to flow through line 102 to the funnel drive motor 36. Rotation of the funnel by drive motor 36, as explained previously, results in elimination of the hang-up in funnel 20, whereby motors 59 and 60 may again drive the feed rollers, and the pressure in line 115 returns to normal (and thus valve 107 is returned to its normal position, and the power for motor 36 is cut off).

Fluid is supplied through line 95 to rams 70 and 80 as described previously. Preferably, all items drain to return line 120, through filter 121, back to main reservoir 92.

The chipper assembly 14, shown in FIG. 1, is conventional and may be of the type disclosed in U.S. Pat. No. 3,524,485. The chipper is of the self-feeding type; however, the feed rollers 52,62 are necessary since the selffeeding power is not always sufficient for smooth and constant feeding. Since it is preferred that the same diesel engine, that powers the pump 94 for the hydraulic circuitry (and thus feed roller motors 59,60) also powers the chipper assembly 14, the speed of the feed rollers will be proportional to the speed of the chipper and its ability to receive the tree fed by the feed rollers. It is noted that the centerline 124 of the entrance 125 for the chipper assembly 14 is located in line with or slightly above the centerline 27 of the funnel opening 26. Also, the entrance 125 for the chipper assembly 124 may be made larger than the opening 26 for the funnel so that any hang-ups that do occur will occur in the funnel (where they can be dealt with) rather than in the chipper, and also so that the chipper assembly can receive various angles of tilt of trees fed thereto.

OPERATION

The whole assembly 10 is shown in FIG. 1 during operation. A boom-mounted grapple 18 associated with the assembly picks up the butt end of a tree 19 and drags the tree toward the assembly 10. The butt end of the tree is moved through opening 22 of the funnel receiving structure 20, while the top of the tree still engages the ground, and is then guided by the interior surfaces 28 of the funnel 20 through the interior funnel opening 26. The diesel motor (not shown) is started to run chipper 14 and pump 94. The operator then operates the manual override valve 130 for the valve 86 in order to properly position the rod 81 within its cylinder, and thus the roller 52 with respect to the incoming tree if the roller 52 is not already properly positioned. The operator then activates valve 111 to supply power for the hydraulic motors 59 and 60 driving the feed rollers 52 and 62. The free-floating feed rollers 52 and 62 then drive the butt end of the tree to the chipper entrance 125 and into the chipper assembly 14, whereupon the tree is reduced to chips. As the tree is fed through the assembly 10, the angle that the tree makes with respect to the centerline 27 of the funnel opening 26 will gradually change, but this change is automatically compensated for by the free-floating rollers.

During normal operation of the device, the limbs of the tree 19 will be deflected by the interior surfaces 28 of the funnel 20 so that they may pass through the opening 26 along with the trunk of the tree. Should a limb or limbs become "hung-up" in the funnel 20, however, the pressure in line 115 of roller control system 110 will increase, activating pressure-responsive valve 107 for funnel motor control system 100. This will allow fluid to be supplied to funnel hydraulic motor 36, which will cause the funnel to rotate about its supports 24,30. The rotation of the funnel 20 will result in the twisting of some of the limbs within funnel 20 — while the rotation of the trunk of the tree is prevented by rollers 52,62 — and will result in the cutting of other tree limbs by the blades 44 of the teeth 41 arranged along the interior surface 28 of the funnel 20 in a particular manner. The combined effect of the cutting and twisting will almost always result in the freeing of the hang-up, resulting in a pressure reduction in line 115 and thereby a closing off of pressure-responsive valve 107 to stop the rotation of the funnel 20 by the motor 36. It will thus be seen that a whole tree chipping assembly having reduced down-time and of smaller size has been disclosed.

Although the invention has been herein disclosed in what is presently conceived to be the most practical and preferred embodiment, it is obvious that many modifications may be made thereof within the scope of the invention, which scope is not to be limited except by the appended claims.

I claim:

1. A whole tree chipper assembly for use with a boom-mounted grapple operable to lift the butt end of a whole tree and bring it into operative relationship with said assembly while the top of said tree remains on the ground for reduction to chips by said assembly, said assembly comprising:

a. a frame, b. a chipper carried by said frame for reducing to chips whole trees fed thereto, c. a whole tree receiving structure carried by said frame having an opening therein of a size to permit the butt end of a whole tree to pass therethrough and converging surface means leading to said opening in the direction of feed of said tree, d. first and second feed rollers carried by said frame between said chipper and said receiving structure for engaging the periphery of said tree extending through said opening and feeding the same to said chipper, e. means for mounting each of said rollers on said frame for rotational movement about a respective axis, for movement toward and away from each other, and for joint movement in a direction generally transverse to their axes of rotation and to the feed direction of said tree, f. means for rotating each of said feed rollers about its respective axis to provide the feeding action of said rollers, g. means for connecting said mounting means for said rollers together for biasing said rollers toward each other during operation of said assembly, while allowing said rollers to be moved apart, said rollers continuously engaging the periphery of said tree as it is moved through said opening and fed by said rollers to said chipper, and h. means for connecting said mounting means for one of said rollers to said frame for jointly biasing said rollers to a particular orientation with respect to said receiving structure opening during operation of said assembly while allowing said rollers to move with respect to said receiving structure opening, transversely to said feed direction, dependent upon the angle at which a tree received by said assembly is disposed with respect to the centerline through said opening during feeding of said tree to said chipper by said feed rollers.

2. An assembly as recited in claim 1 wherein said opening in said receiving structure is larger than said entrance for said chipper.

3. An assembly as recited in claim 1 further comprising means for mounting said receiving structure for rotation about an axis through said opening and means for automatically rotating said receiving structure about said axis in response to portions of said tree being hung-up in said receiving structure.

4. An assembly as recited in claim 3 wherein said converging surface means of said receiving structure have teeth disposed thereon for cutting parts of tree portions hung-up in said receiving structure engaged thereby.

5. An assembly as recited in claim 4 wherein said teeth are arranged in two spiral paths, and wherein each of said teeth has a blade with a cutting edge, each cutting edge of each blade of said teeth overlapping the blade of the previously disposed tooth along a respective path and the cutting edge of each of said teeth being disposed at an angle with respect to a radial line of said opening, whereby said cutting by said teeth will be self-feeding, noncoring, and efficient.

6. An assembly as recited in claim 5 wherein the distance of overlap of each tooth with the previously disposed tooth is approximately ⅛ inch, and wherein said angle at which each cutting edge of each tooth is disposed with respect to a radial line is approximately 3°.

7. An assembly as recited in claim 5 wherein the extent to which a blade of a tooth protrudes into said receiving structure from said converging surface means is adjustable.

8. An assembly as recited in claim 3 wherein said converging surface means of said receiving structure have a plurality of sharpened protruding plates disposed thereon for cutting parts of tree portions hung-up in said receiving structure engaged thereby.

9. An assembly as recited in claim 8 wherein each of said sharpened protruding plates is disposed in a spiral path along said converging surface means of said receiving structure.

10. An assembly as recited in claim 3 wherein said means for mounting said receiving structure for rotation about an axis through said opening includes a mounting rim portion of said receiving structure, and a plurality of rollers having the peripheries thereof contoured to receive said rim.

11. An assembly as recited in claim 3 wherein said means for rotating each of said feed rollers comprises a hydraulic motor for each of said feed rollers, and wherein said hydraulic motors are supplied with hydraulic fluid by a first line from a hydraulic fluid reservoir.

12. An assembly as recited in claim 11 wherein said means for automatically rotating said receiving structure about said axis in response to portions of said tree being hung-up in said receiving structure comprises a hydraulic motor, a second line for supplying said hydraulic motor with hydraulic fluid, and a pressure-responsive valve normally closing said second line but movable in response to overpressure in said first line to open said second line and supply fluid to said hydraulic motor for rotating said receiving structure.

13. An assembly as recited in claim 1 wherein said means for connecting said mounting means together for biasing said rollers toward each other comprises a hydraulic ram, said ram during operation of said assembly being supplied with hydraulic fluid through an adjustable pressure reducing valve to bias said rollers together, said valve being adjusted so that the pressure being supplied to said ram is not so great that binding of said tree by said rollers will result.

14. An assembly as recited in claim 1 wherein said means for connecting said mounting means for one of said rollers to said frame for biasing said rollers to a particular orientation comprises a hydraulic ram, said ram during operation of said assembly being supplied with hydraulic fluid through an adjustable pressure reducing valve to orientate said rollers so that a gap therebetween is substantially bisected by the centerline for said opening, said valve being adjusted so that the pressure being supplied to said ram is not so great that said rollers are not able to assume a different orientation with respect to said opening upon receipt of a tree disposed at an angle by said rollers.

15. An assembly as recited in claim 1 wherein said means for mounting each of said rollers on said frame comprises a pair of arms pivotable about a shaft attached to said frame, each arm receiving a shaft of its respective said roller about which said roller is rotatable.

16. An assembly as recited in claim 15 wherein said shafts about which said rollers rotate are disposed horizontally.

17. A whole tree chipper assembly comprising:

a. a frame, b. a chipper carried by said frame for reducing to chips whole trees fed thereto, c. a boom-mounted grapple mounted on said frame for lifting the butt end of a tree while the top of said tree is supported by the ground and moving it into operative relationship with said receiving structure, d. a whole tree receiving structure carried by said frame having an opening therein of a size to permit the butt end of a whole tree to pass therethrough and converging surface means leading to said opening in the direction of feed of a tree, e. first and second feed rollers carried by said frame between said chipper and said receiving structure for engaging the periphery of a tree extending through said opening and feeding the same to said chipper, f. means for mounting each of said rollers on said frame for rotational movement about a respective axis, for movement toward and away from each other, and for joint movement in a direction generally transverse to their axes of rotation and to the feed direction of said tree, g. means for rotating each of said feed rollers about its respective axis to provide the feeding action of said rollers, h. means for connecting said mounting means for said rollers together for biasing said rollers toward each other during operation of said assembly, while allowing said rollers to be moved apart, said rollers continuously engaging the periphery of said tree as it is moved through said opening and fed by said rollers to said chipper, and i. means for connecting said mounting means for one of said rollers to said frame for jointly biasing said rollers to a particular orientation with respect to said receiving structure opening during operation of said assembly while allowing said rollers to move with respect to said receiving structure opening, transversely to said feed direction, dependent upon the angle at which a tree received by said assembly is disposed with respect to the centerline through said opening during feeding of said tree to said chipper by said feed rollers.

18. An assembly as recited in claim 17 further comprising means for mounting said receiving structure for rotation about an axis through said opening and means for automatically rotating said receiving structure about said axis in response to portions of said tree being hung-up in said receiving structure.

19. An assembly as recited in claim 18 wherein said converging surface means of said receiving structure have means disposed thereon for cutting parts of tree portions hung-up in said receiving structure engaged thereby.

20. An assembly as recited in claim 17 wherein said means for rotating each of said feed rollers comprises a hydraulic motor for each of said feed rollers, and wherein said hydraulic motors are supplied with hydraulic fluid by a first line from a hydraulic fluid reservoir.

21. An assembly as recited in claim 20 wherein said means for automatically rotating said receiving structure about said axis in response to portions of said tree being hung-up in said receiving structure comprises a hydraulic motor, a second line for supplying said hydraulic motor with hydraulic fluid, and a pressure-responsive valve normally closing said second line but movable in response to overpressure in said first line to open said second line and supply fluid to said hydraulic motor for rotating said receiving structure.

22. An assembly as recited in claim 17 wherein said means for connecting said mounting means together for biasing said rollers toward each other comprises a hydraulic ram, said ram during operation of said assembly being supplied with hydraulic fluid through an adjustable pressure reducing valve to bias said rollers together, said valve being adjusted so that the pressure being supplied to said ram is not so great that binding of said tree by said rollers will result.

23. An assembly as recited in claim 17 wherein said means for connecting said mounting means for one of said rollers to said frame for biasing said rollers to a particular orientation comprises a hydraulic ram, said ram during operation of said assembly being supplied with hydraulic fluid through an adjustable pressure reducing valve to orientate said rollers so that a gap therebetween is substantially bisected by the centerline for said opening, said valve being adjusted so that the pressure being supplied to said ram is not so great that said rollers are not able to assume a different orientation with respect to said opening upon receipt of a tree disposed at an angle by said rollers.

24. A whole tree chipper assembly for use with a boom-mounted grapple for lifting the butt end of a whole tree and bringing it into operative relationship with said assembly while the top of said tree remains on the ground, said assembly comprising:

a. a frame,
b. a funnel for receiving a whole tree having an opening therein of a size to permit the butt end of a whole tree to pass therethrough,
c. means for mounting said funnel on said frame for rotation about an axis extending through said opening,
d. means for rotating said funnel about said axis in response to portions of a tree being hung-up in said funnel,
e. a chipper carried by said frame for reducing to chips a whole tree fed thereto, and
f. free-floating feed rollers for feeding tree from said opening to said chipper.

25. An assembly as recited in claim 24 wherein said funnel has disposed along spiral paths on the interior surface thereof a plurality of teeth for cutting parts of tree portions hung-up in said funnel engaged thereby.

26. An assembly as recited in claim 25 wherein each of said teeth has a blade with a cutting edge, each cutting edge of each blade of said teeth overlapping the blade of the tooth previously disposed along a respective path, and the cutting edge of each of said teeth being disposed at an angle with respect to a radial line of said opening, whereby said cutting by said teeth will be self-feeding, noncoring, and efficient.

27. An assembly as recited in claim 24 wherein said funnel has disposed on the interior surface thereof a plurality of sharpened protruding plates for cutting parts of the tree portions hung-up in said funnel engaged thereby.

28. An assembly as recited in claim 25 wherein each of said plates is disposed along a spiral path on the interior surface of said funnel.

29. An assembly as recited in claim 24 wherein said means for mounting said funnel for rotation about said axis includes a mounting rim portion of said funnel, and a plurality of rollers having the peripheries thereof contoured to receive said rim.

30. An assembly as recited in claim 24 wherein said means for rotating said funnel about said axis includes a hydraulic motor fed by a first hydraulic line, a fluid pressure-responsive valve located in said first line for normally preventing fluid flow through said line but allowing fluid flow through said line to actuate said motor upon an overpressure condition in a second fluid line.

31. An assembly as recited in claim 30 wherein said free-floating rollers are rotated by hydraulic motors supplied with hydraulic fluid by said second fluid line, overpressure in said line resulting when said motors cannot rotate said rollers due to a hang-up of said tree in said funnel.

32. A method of reducing successive cut whole trees lying on the ground to chips which comprises the steps of a. gripping successive cut whole trees at a position near but spaced from the butt end thereof,
b. moving successive gripped cut whole trees longitudinally into a fixed feed position with the top portion of each successive whole tree supported by the ground without changing the position of gripping thereof,
c. engaging opposed peripheral portions of the butt end of each successive whole tree at said fixed feed position,
d. releasing the gripping action at said fixed feed position after the aforesaid engagement,
e. progressively moving the engagement of the opposed portions of the butt end of each successive whole tree at said fixed feed position in a direction toward the top of the tree to thereby move the whole tree generally in a longitudinal direction, butt end first, into a fixed chipping position, and
f. progressively cutting chips from the butt end of the tree at said fixed chipping position during the aforesaid movement of said tree therein.

33. A method as recited in claim 32 comprising the further step of twisting the tree and cutting off hung-up branches thereof at said fixed feed position to assist in progressive movement of the tree.

34. Apparatus for reducing successive cut whole trees lying on the ground to chips, said apparatus comprising:

a. means for gripping successive cut whole trees at a position near but spaced from the butt end thereof,
b. means for moving successive gripped cut whole trees longitudinally into a fixed feed position with the top portion of each successive whole tree supported by the ground, without changing the position of gripping thereof,
c. means for, after release of said gripping means engaging opposed peripheral portions of the butt end of each successive whole tree at said fixed feed position and progressively moving the engagement of the opposed portions of the butt end of each successive whole tree at said fixed feed position in a direction toward the top of the tree to thereby move the whole tree generally in a longitudinal direction, butt end first, into a fixed chipping position, and
d. means for progressively cutting chips from the butt end of the tree at said fixed chipping position during the aforesaid movement of said tree therein.

35. Apparatus as recited in claim 34 further comprising means for twisting the tree and cutting off hung-up branches thereof at said fixed feed position to assist in progressive movement of the tree.

* * * * *